US006036539A

United States Patent [19]

Rigby et al.

[11] Patent Number: 6,036,539

[45] Date of Patent: Mar. 14, 2000

[54] SHIELDED CABLE CONNECTOR THAT ESTABLISHES A GROUND CONNECTION BETWEEN A CABLE HOUSING AND AN ELECTRICAL CONNECTOR BODY

[75] Inventors: William J. Rigby, Somis; Scott S. Blaise; Thomas G. Conway, both of Camarillo, all of Calif.

[73] Assignee: Component Equipment Company, Inc.

[21] Appl. No.: 09/185,433

[22] Filed: Nov. 3, 1998

[51] Int. Cl.[7] ..... H01R 9/05

[52] U.S. Cl. ..... 439/579

[58] Field of Search ..... 439/579, 497, 439/610

[56] References Cited

U.S. PATENT DOCUMENTS 5,618,202 4/1997 Okuyama ..... 439/497

*Primary Examiner*—Khiem Nguyen
*Assistant Examiner*—Javaid Nasri
*Attorney, Agent, or Firm*—Jack C. Munro

[57] ABSTRACT

A method of making an electrical connection with a cluster of separate electrical conductors wherein each of the electrical conductors are frayed at its end exposing a center wire and a ground shield. The cable is mounted within a cable housing. The center wire of each electrical conductor is attached to a separate female center conductor. The cable housing is interconnected with a connector body which includes the female center conductors. The connector body also includes ground contacts which connect with the ground shields to achieve a grounding electrical connection from the cable housing through the connector body.

9 Claims, 2 Drawing Sheets

SHIELDED CABLE CONNECTOR THAT ESTABLISHES A GROUND CONNECTION BETWEEN A CABLE HOUSING AND AN ELECTRICAL CONNECTOR BODY

BACKGROUND OF THE INVENTION

1) Field of the Invention

This invention is related to an electrical connector and more particularly to an electrical connector which establishes an electrical connection between a printed circuit board and a coaxial cable which contains a cluster of separate electrical conductors.

2) Description of the Prior Art

Electronic components used in both telephone equipment and computers are commonly mounted on printed circuit boards. The printed circuit board is a sheet material-like member on which is mounted an electrical circuit and a plurality of electrical components, such as capacitors, resistors and inductors. Within each piece of equipment there is commonly a plurality of printed circuit boards.

Generally, it is common for a printed circuit board to be connected to a cable. A common form of a cable is what is referred to as a coaxial cable with this coaxial cable including a cluster of separate electrical conductors. A type of coaxial cable will have from one to twenty-four or more in number of separate electrical conductors. In the past, each of the separate electrical conductors are connected individually directly to the printed circuit board with this connection being by individual soldering. One disadvantage of such an attachment technique is that substantial space is required. Miniaturization of electrical components is highly desirable. The smaller the physical size, the smaller the resultant electronic piece of equipment and the less space it requires when in operation. The smaller the size, the less the weight of the equipment thereby reducing shipping cost. The construction of a cable connector to a printed circuit board which utilizes the technique of the present invention has not been known.

SUMMARY OF THE INVENTION

The subject invention is to provide an electrical connection with a printed circuit board from a cable to the printed circuit board. A connector body is utilized within which is mounted a plurality of elongated female center conductors each of which comprises an elongated member with each end of the female center conductor being formed into a female socket. These center conductors are mounted parallel to each other and the female sockets of one end are to connect with male plugs of the printed circuit board. The opposite end of the center conductors are each to be electrically connected to a center wire of an electrical conductor of a cable. The cable is fixedly mounted within a cable housing. Surrounding the center wire of the electrical conductor is braiding forming a ground shield. This ground shield is exposed and flared in the area of the connection of the center wire with the female center conductor. The connector body is then interconnected with the cable housing. When making of this interconnection, an electrical grounding circuit is established with the ground shield.

The primary objective of the present invention is to create an electrical connecting arrangement of a cable with a printed circuit board with the connecting arrangement being obtained in a much smaller space than was required within the prior art.

Another objective of the present invention is to achieve a shielded cable connector which has a high degree of performance and maintains a shielded electrically coaxial environment between the coaxial cable and printed circuit board.

DETAILED DESCRIPTION OF THE PREFERRED EMBODIMENT

Figure 1:
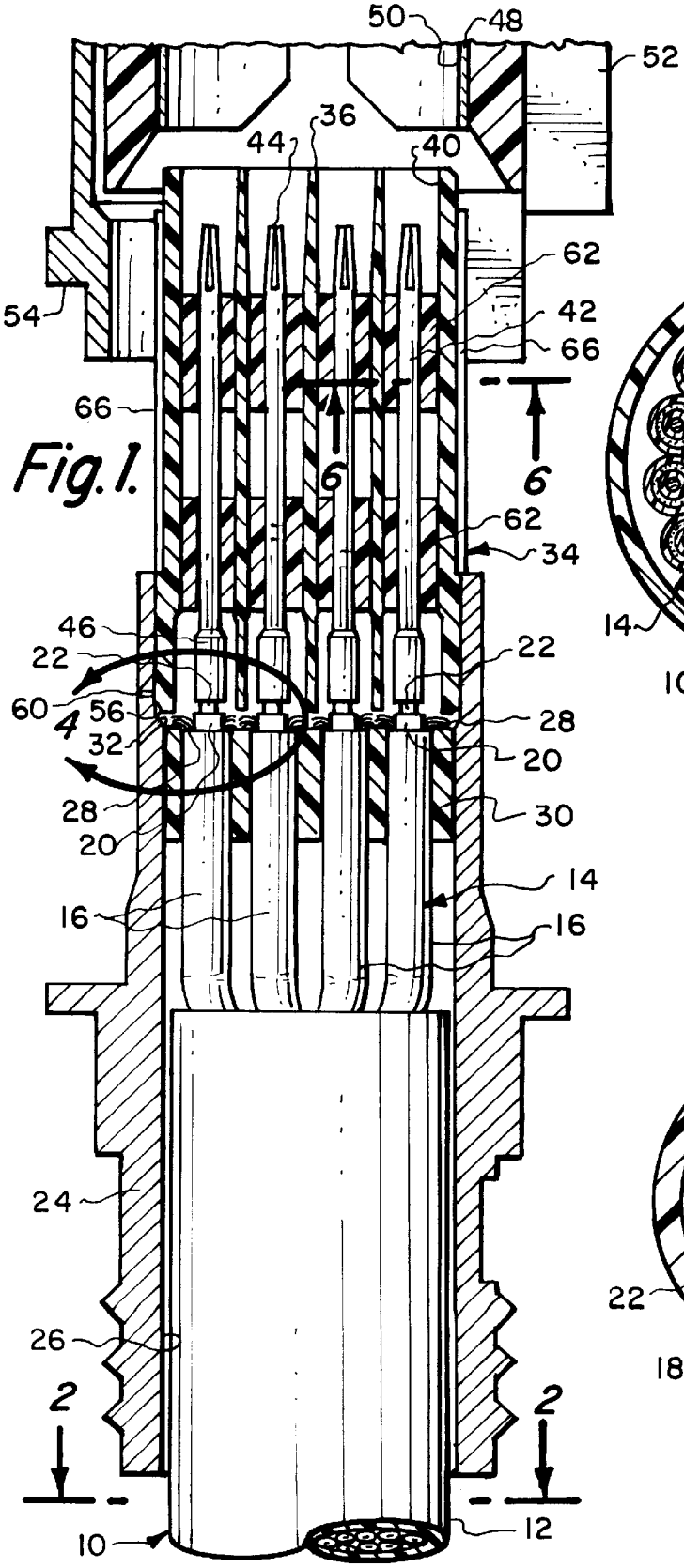
FIG. 1 is a longitudinal cross-sectional view of the cable connector of the present invention.
Figure 2:
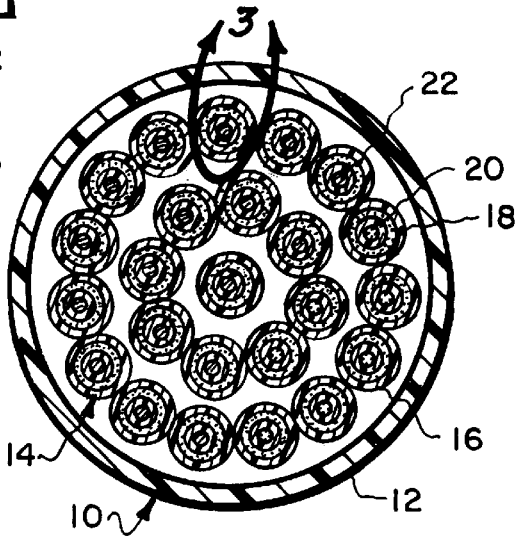
FIG. 2 is a cross-sectional view of the cable connector of the present invention through the cable which includes a cluster of electrical conductors taken along line 2—2 of FIG. 1.
Figure 3:
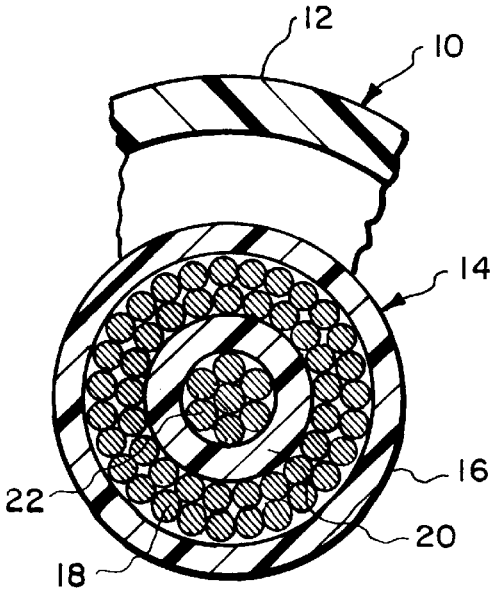
FIG. 3 is an enlarged view of one of the electrical conductors of the cable of FIG. 2 taken along line 3—3 of FIG. 2.

Referring particularly to the drawings, there is shown in FIG. 1 an electrical cable 10 which has an outer electrically insulative, normally plastic, jacket 12. Enclosed within the jacket 12 are twenty-four in number of electrical conductors 14. Each electrical conductor 14 is encased within an insulative jacket 16. Within the insulative jacket 16 is located a tubular configuration of braiding 18 which surrounds an insulative, tubular cover 20. Contained within the insulative, tubular cover 20 is a center wire 22 which is normally constructed of a plurality of twisted strands. The cable 10 is fixedly mounted within a cable housing 24 which will normally be constructed of a metal or plastic. The cable 10 is mounted within internal chamber 26 of the cable housing 24. Prior to mounting of the cable 10 within the internal chamber 26, the outer end of the electrical conductors 14 are exposed from the jacket 12 with the portion of the jacket 12 being removed at the outer end of the electrical conductors 14. The outer end of each electrical conductor 14 has the insulative jacket 16 removed therefrom. This will expose the outer end 28 of the braiding 18 which will comprise the ground shield. A small portion of the insulative tubular cover 20 is removed from each of the electrical conductors 14 in order to expose the center wire 22.

The electrical conductors 14 are each mounted in a precise position within the cable housing 24 by inserting of a plastic spacer member 30 in between and around the electrical conductors 14. The electrical conductors 14 are arranged in a rectangular pattern forming rows and columns of conductors 14. Within a row there will be four conductors 14 and in each column there will be six conductors 14. The plastic spacer member 30 is mounted between all of the conductors 14 and between the conductor 14 and the cable housing 24. The conductors 14 of each row are located parallel to the conductors 14 of other rows. The same is true for the columns of the conductors 14. The internal chamber 26 has a surrounding, inclined ledge 32. The insulative, tubular cover 20 that is exposed directly adjacent the exposed portion of the center wire 22 is located directly adjacent this ledge 32.

Figure 4:
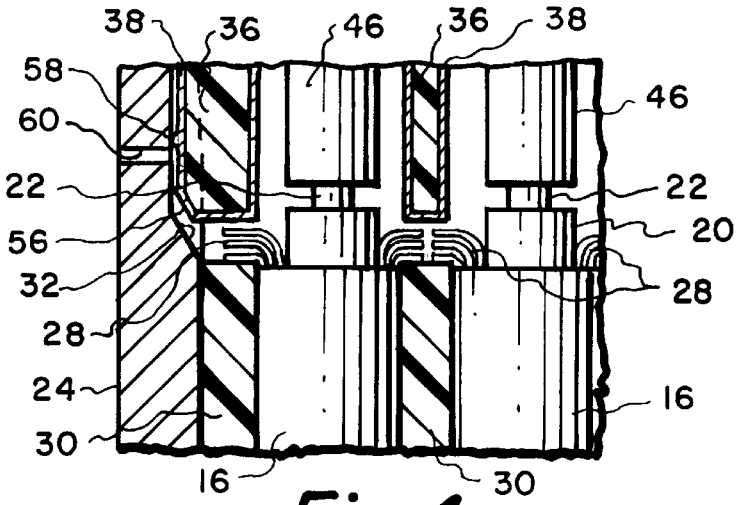
FIG. 4 is an enlarged view showing in more detail the electrical arrangement established by the cable connector of the present invention taken along line 4—4 of FIG. 1 showing the cable connector not in the fully connected position.
Figure 5:
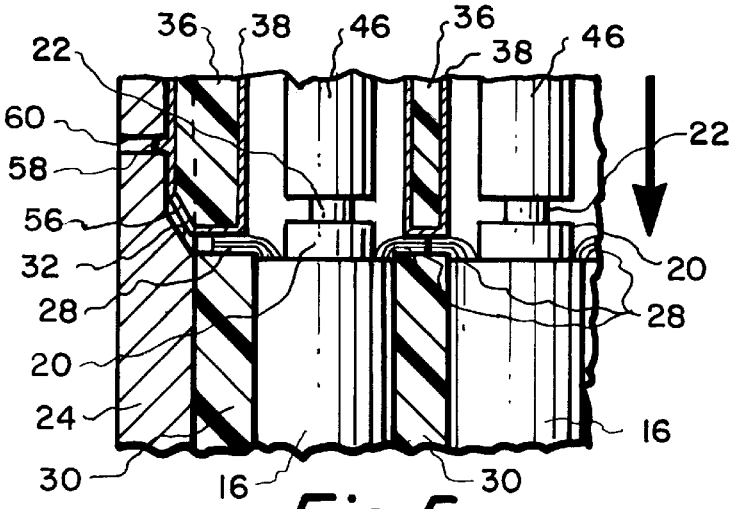
FIG. 5 is a view similar to FIG. 4 but showing the cable connector in the fully connected position.
Figure 6:
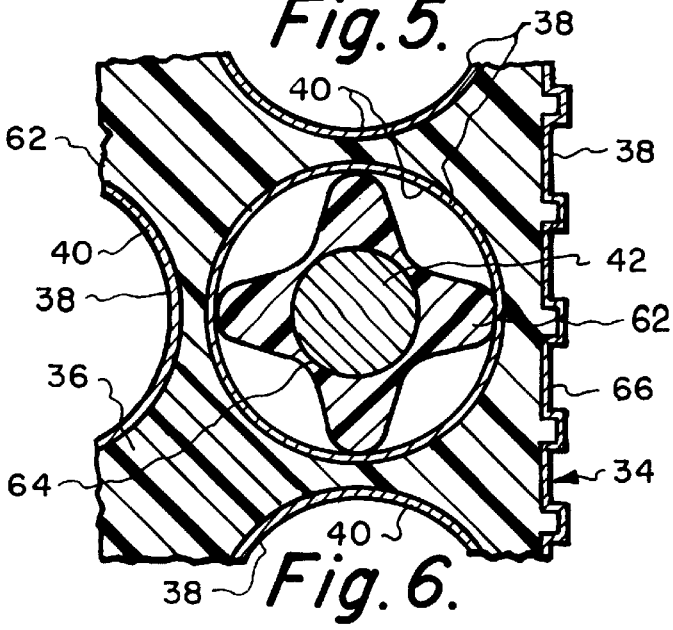
FIG. 6 is a cross-sectional view taken along line 6—6 of FIG. 1.

The cable connector of the present invention also utilizes a connector body 34. The connector body 34 will normally be constructed of a plastic interior 36 the entire exterior surface of which is coated with a layer 38 of an electrically conductive metal. This coating is to be accomplished by electrolytic deposition. This process of coating is discussed in detail in the inventor's previous U.S. Pat. No. 5,718,606. The connector body 34 has a plurality of evenly spaced-apart holes 40 with actually there being twenty-four in number of such holes which is equal to the number of the electrical conductors 14. Within each hole 40 there is mounted an elongated female center conductor 42. The upper end of each female center conductor 42 defines a bifurcated socket 44 and the lower end of the elongated female 42 is formed into a crimping socket 46. It is to be understood that the crimping socket 46 has an internal opening within which is to be located a center wire 22. The center wire 22 of each of the electrical conductors 14 are to connect with a separate crimping socket 46. When located within the crimping socket 46, the socket 46 is then crimped or can be soldered in order to form a physically secure connection between the socket 46 and the center wire 22. The cable housing 24 is actually constructed of two parts which mate together, which is not shown. The crimping of the sockets 46 to each center wire 22 is accomplished with the two parts of the cable housing 24 being separated in order to provide access to the sockets 46. Also, this crimping is accomplished with the connector body 34 not being completely installed but being some slightly spaced distance from the completely installed position, which is shown in FIG. 4 of the drawings.

When each of the center wires 22 are connected to its respective socket 46, the installer will then flare outwardly the outer end 28 of the braiding 18 in a direction away from their each respective insulative tubular cover 20. Actually, the outer end 28 is to be positioned against the end of each of the plastic spacers 30 as shown in FIG. 4 of the drawings. The installer then proceeds to physically move the connector body 34 in a direction toward the plastic spacers 30 which will result in the metallic layer 38 establishing a tight compressing of the outer end 28 against the plastic spacers 30. The result is that an electrical ground has been established between the outer end 28 of the braiding 18 and the metallic layer 38. This grounding connection is completed by the layer 38 being in contact with metallic layer 48 of a socket 50 of a printed circuit board 52. The socket 50 is encased by a metal housing 54 which is mounted on the printed circuit board 52. When the connector body 34 is in the fully inserted position with the cable housing 24, an inclined surface 56 will be located directly against the inclined ledge 32. When the connector body 34 is in this position with the cable housing 24, there is a protrusion 58 which is mounted on the exterior surface of the connector body 34 that will snap into a hole 60 formed within the cable housing 24. When protrusion 58 so engages with hole 60, the totally installed position is established between the cable housing 24 and the connector body 34. The protrusion 58 and hole 60 comprise a detent. It is to be understood that when the connector body 34 is completely installed within the socket 50 that each of the bifurcated sockets 44 will electrically connect with a separate plug, which is not shown. Each separate plug will be inserted within each bifurcated socket 44.

Each of the elongated female conductors 42 is to be centrally mounted within its respective hole 40. In order to accomplish this, each elongated female conductor 42 is mounted through a pair of insulative bushings 62. It is desirable to have air to be freely passed through each hole 40 with this air functioning as an electrical insulator relative to each elongated female center conductor 42. In order to accomplish this, each bushing 62 has a non-circular configuration which includes four in number of elongated recesses 64. The air is conducted through the recesses 64.

The exterior surface of the connector body 34 includes a plurality of elongated ribs 66. These ribs 66 are for ornamentation and also to facilitate manual gripping of the connector body 34 when making of the installation procedure in conjunction with the cable housing 24.

With the connector body 34 completely installed within the socket 50, there is a positive electrical conductive path between the cable 10 and the printed circuit board 52 established by each of the center wires 22 through its respective elongated female center conductor 42. This positive side of the electrical circuit is completed by means of the grounding circuit which is established between the metallic layers 48 and 38 and the outer end of the braiding 18. It is to be understood that the braiding 18 electrically grounded at the outer end of the cable 10 which is shown in the drawings.

What is claimed is:

1. A shielded cable connector comprising:

a cable composed of a plurality of electrical conductors, said electrical conductors being mounted within a cable housing, a plastic spacer member located about said electrical conductors, said plastic spacer member being mounted within said cable housing, each electrical conductor of said electrical conductors having a center wire surrounded by an electrically conductive braiding, said braiding having an outer end, said outer end being flared outwardly to rest against said plastic spacer member; and a connector body having a plurality of female conductors, said connector body being coated with a layer of electrically conductive metal, said layer to electrically connect with said outer end by a first connection with said connector body interconnecting with said cable housing, each said center wire of said electrical conductor to electrically connect with a said female conductor by a second connection.

2. The shielded cable connector as defined in claim 1 wherein:

said first connection comprising a tight compressing of said outer end between said plastic spacer member and said connector body.

3. The shielded cable connector as defined in claim 1 wherein:

said second connection comprising a socket of each said female conductor into which said center wire is inserted and secured tightly into engagement.

4. The shielded cable connector as defined in claim 1 wherein:

said connector body being interconnected with said cable housing by a detent.

5. A shielded cable connector comprising:

a cable having at least one electrical conductor, said electrical conductor being mounted within a cable housing, a plastic spacer member located about said electrical conductor, said plastic spacer member being mounted within said cable housing, said electrical conductor having a center wire surrounded by an electrically conductive braiding, said braiding having an outer end, said outer end being flared outwardly to rest against said plastic spacer member; and a connector body having a female connector, said connector body being coated with a layer of electrically conductive metal, said layer to electrically connect with said outer end by a first connection, said layer to electrically connect with said outer end by said connector body interconnecting with said cable housing, said center wire to electrically connect with said female conductor by a second connection.

6. The shielded cable connector as defined in claim 5 wherein:

said first connection comprising a tight compressing of said outer end between said plastic spacer member and said connector body.

7. The shielded cable connector as defined in claim 5 wherein:

said second connection comprising a socket of said female conductor into which said center wire is inserted and secured tightly into engagement.

8. The shielded cable connector as defined in claim 5 wherein:

said connector body being interconnected with said cable housing by a detent.

9. A method of making an electrical connection with electrical conductors of a coaxial cable where each said electrical conductor has a center wire surrounded by an electrically conductive braiding each said center wire and said braiding is covered by an electrically insulative cover comprising:

exposing at an outer end of each said electrical conductor said center wire and said braiding by removing of a portion of said electrically insulative cover;

mounting said electrical conductors within a cable housing with a plastic spacer member located about the electrical conductors;

utilizing a connector body having a plurality of female conductors where the connector body is coated with a layer of electrically conductive metal which is electrically insulated from said female conductors;

attaching each said center wire to a separate said female conductor establishing an electrical connection therebetween; and physically interconnecting said cable housing and said connector body producing an electrical grounding connection between said braiding and said layer.

* * * * *